United States Patent [19]

Ficek

[11] 4,061,181

[45] Dec. 6, 1977

[54] APPARATUS FOR CENTRIFUGAL CASTING IN SPLIT MOLDS

[75] Inventor: Jan Ficek, Zabrze, Poland

[73] Assignee: Przedsiebiorstwo Projektowania i Wyposazania Zakladow Przemyslu Maszyn i Aparatow Ekejtrtczbtcg "Promel", Gliwice, Poland

[21] Appl. No.: 766,496

[22] Filed: Feb. 7, 1977

[30] Foreign Application Priority Data

Feb. 11, 1976 Poland ..... 187182

[51] Int. Cl.[2] ..... B22D 13/10

[52] U.S. Cl. ..... 164/292; 164/295; 425/435

[58] Field of Search ..... 164/292, 295, 343, 344, 164/404; 425/435

[56] References Cited

U.S. PATENT DOCUMENTS

| | | | |
|---|---|---|---|
| 1,715,418 | 6/1929 | Langenberg | 164/344 X |
| 2,666,952 | 1/1954 | Lawson et al. | 425/435 X |
| 3,488,692 | 1/1970 | Oda et al. | 164/404 X |
| 3,670,803 | 6/1972 | Dehnhard | 164/343 X |

*Primary Examiner*—Robert D. Baldwin

[57] ABSTRACT

An apparatus for centrifugal casting in split molds has a rotatable casting head which is in the form of a hollow frustum of a cone. The head is provided with circumferentially spaced slots which extend along the generatrices of the cone. Each of the slots slidably receives a section of a mold, the various sections being so designed as to define a mold with one another when the sections are properly positioned relative to one another. Each of the mold sections is connected with, but is rotatable relative to, a hollow, primary piston which draws the mold sections together and moves them apart. A jaw chuck having a pair of jaws pivotally mounted thereon is arranged for rotation with the mold sections. The jaws are activated by a rod connected with a secondary piston which reciprocates inside the hollow, primary piston and may be moved independently thereof or in unison therewith. The rod is rotatable relative to the secondary piston. In operation, the primary and secondary pistons are displaced in a sense causing the mold sections to come together and causing the jaws to be moved away from the mold sections. The mold defined by the mold sections is filled with molten metal and the casting head is set into rotation. When the casting made in the mold has solidified, the primary and secondary pistons are activated causing the mold sections to move apart and causing the jaws to open and move towards the casting. When the jaws embrace the casting, the secondary piston closes the jaws and the primary and secondary pistons are thereafter displaced in a sense causing the casting to be withdrawn from the casting head and causing the mold sections to move back together.

6 Claims, 1 Drawing Figure

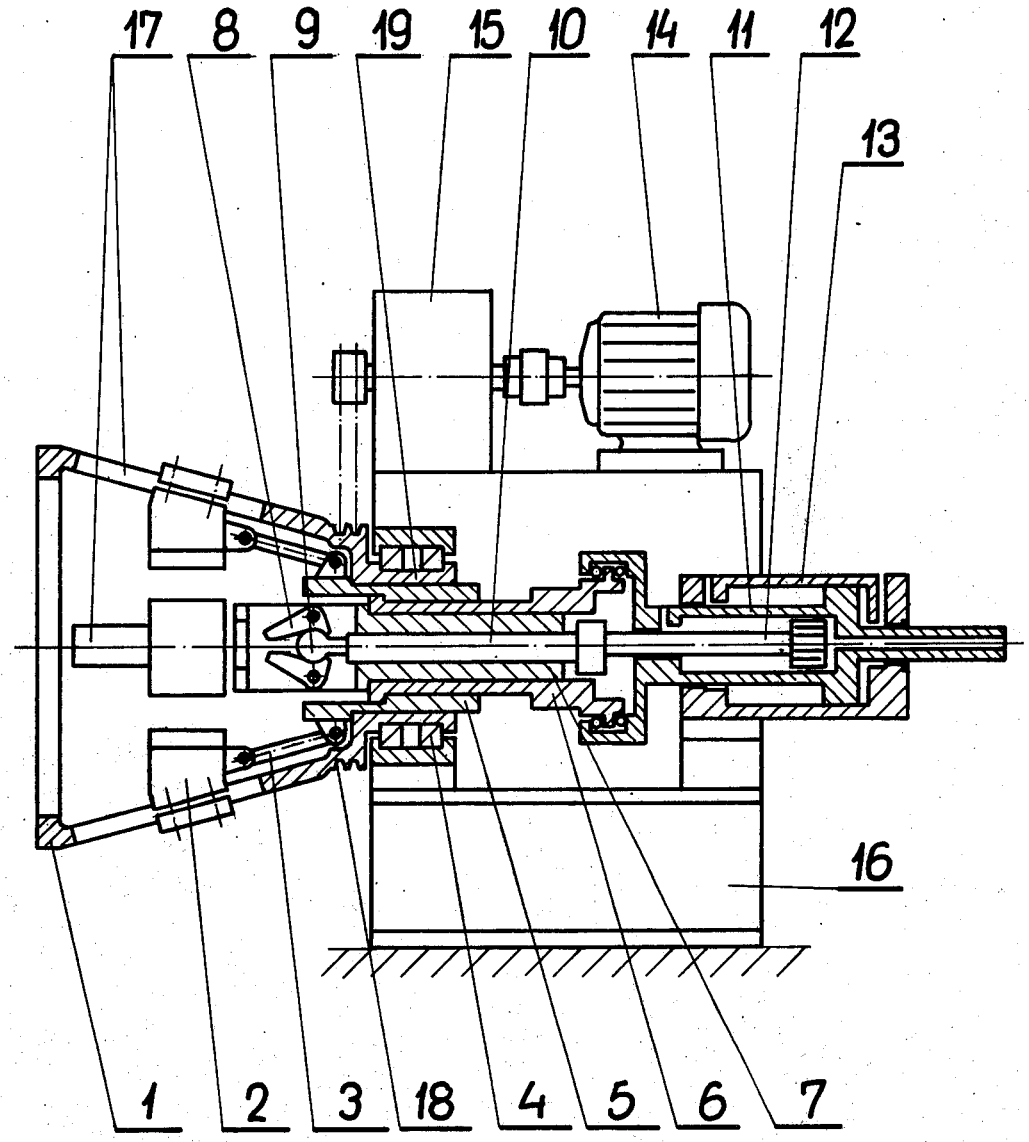
17
8
9
19
15
10
14
11
12
13
16
1
2
3
18
4
5
6
7

APPARATUS FOR CENTRIFUGAL CASTING IN SPLIT MOLDS

FIELD OF THE INVENTION

The invention broadly relates to centrifugal casting. More particularly, the invention relates to apparatus for centrifugal casting in split molds.

BACKGROUND OF THE INVENTION

An arrangement for removing molds and castings from the heads of centrifugal casting apparatus is known for apparatus of the type utilizing non-split molds. The arrangement includes jaws for gripping the castings and an hydraulic cylinder for activating the jaws. Two pairs of stops are fixedly mounted on the cylinder and the ends of the stops cooperate with the rotor of the mold. A yoke having the form of double-armed articulated lever is secured to each of the stops. A pair of servomotors symmetrically arranged with respect to the axis of the device are connected with the yolks for displacing the same.

Non-split molds are only suitable for the casting of relatively simple shapes. For more complicated shapes, such as those of electric motor casings and other articles of somewhat complex but generally cylindrical configuration, it is necessary to use split molds for the casting operation. Unfortunately, there are difficulties associated with the removal of such complicated castings from the molds and the displacement of the castings from the casting head. It would be desirable if, similarly to the apparatus described above for non-split molds, an apparatus for centrifugal casting with split molds could be devised which would enable removal of the castings from the mold and displacement of the castings from the casting head to be simplified.

OBJECTS OF THE INVENTION

It is an object of the invention to provide an apparatus for centrifugal casting which enables the casting of articles of complex shape to be simplified.

Another object of the invention is to provide an apparatus for centrifugal casting in split molds which makes it possible to remove the casting from the mold more readily than heretofore.

An additional object of the invention is to provide an apparatus for centrifugal casting in split molds which enables the casting to be displaced from the casting head more simply than heretofore.

SUMMARY OF THE INVENTION

According to the invention, an apparatus for centrifugal casting in split molds comprises a rotatable casting head having the configuration of a hollow frustum of a cone. The casting head is provided with a plurality of circumferentially spaced, elongated slots which extend along the generatrices of the cone. A plurality of mold sections which cooperate to define a mold for centrifugal casting is mounted in the slots. Each of the mold sections is slidable in the slots from a first position in which the mold sections cooperate to define the mold to a second position in which the sections are separated from one another so as to expose a casting which has been formed in the mold. Gripping means, e.g., a pair of jaws, is provided for gripping the casting when the mold sections are separated from one another and for withdrawing the casting from the casting head. The gripping means is mounted for axial movement interiorly of the casting head. Activating means, e.g., an hydraulic arrangement, is provided for displacing the mold sections and the gripping means and for causing the latter to grip the casting. Drive means is also provided for rotating the casting head when the mold sections are together to form the mold so as to permit a centrifugal casting operation to be effected.

BRIEF DESCRIPTION OF THE DRAWING

Other features of the invention will become apparent when the following description is read in connection with the accompanying drawing wherein:

the single FIGURE is a side view, partially in section, of an apparatus according to the invention for centrifugal casting in split molds.

DESCRIPTION OF THE PREFERRED EMBODIMENTS

An apparatus according to the invention for centrifugal casting in split molds is seen from the single FIGURE to include a support 16 on which there is mounted a bearing 4. A casting head 1 is rotatably mounted in the bearing 4. The casting head 1 is configurated as a hollow frustum of a cone and is provided with a cylindrical extension 19 at the smaller-diameter end thereof. The casting head 1 is mounted for rotation in the bearing 4 via the extension 19.

Rotation of the casting head 1 is effected via an electric motor 14 and a variable-speed transmission 15 connected with the motor 14. A non-illustrated belt operatively connects the casting head 1 with the transmission 15.

The frusto-conical casting head 1 is provided with circumferentially spaced, elongated slots 17 which extend along the generatrices of the cone. A mold section 2 is slidably mounted in each of the slots 17. When the mold sections 2 are displaced towards the larger-diameter end of the casting head 1, the mold sections 2 move away from one another. On the other hand, when the mold sections 2 are displaced towards the smaller-diameter end of the casting head 1, the mold sections 2 approach one another. The casting head 1 and the mold sections 2 are designed in such a manner that the mold sections 2 cooperate to define a mold when the mold sections 2 are moved as far as possible towards the smaller-diameter end of the casting head 1.

An outer sleeve 5 is slidably received in the cylindrical extension 19 of the casting head 1. The outer sleeve 5 is connected with the mold sections 2 via respective links 3 each of which is pivotally connected to a mold section 2 at one end and to the outer sleeve 5 at the other end.

An inner sleeve 6 is slidably received in the outer sleeve 5. At the end thereof remote from the casting head 1, the inner sleeve 6 is connected with a hollow, primary piston 11 which is arranged to reciprocate in a cylinder 13. The connection between the inner sleeve 6 and the piston 11 is such that the inner sleeve 6 is displaced in response to motion of the piston 11 but is rotatable relative to the piston 11. The inner sleeve 6 and the outer sleeve 5 are provided with confronting abutment surfaces so that the motion of the piston 11 may be transmitted to the outer sleeve 5 via the inner sleeve 6. The displacement of the outer sleeve 5 achieved in this manner is transmitted to the mold sections 2 via the links 3 thereby causing the mold sections 2 to move along the slots 17.

A chuck 7 is slidably mounted interiorly of the inner sleeve 6. A pair of jaws 8 is pivotally mounted on the chuck 7. The jaws 8 have confronting arcuate surfaces defining a gap therebetween and the spherical head of a rod 9 is located in the gap between the jaws 8 and engages the arcuate surfaces of the latter. The rod 9 is releasably mounted on another rod 10 which extends through a passage provided in the chuck 7. The rod 10 is slidably received in the chuck 7 and the end of the rod 10 remote from the jaws 8 is provided with an enlarged head which bears against the chuck 7 when the rod 10 is displaced towards the jaws 8.

At the end thereof remote from the jaws 8, the rod 10 is connected with a secondary piston 12 which is arranged for reciprocation inside of the hollow primary piston 11. The connection between the rod 10 and the piston 12 is such that the rod 10 undergoes translational motion in response to displacement of the piston 12 but is rotatable relative to the piston 12. The piston 12 serves the dual function of opening the jaws 8, which latter are biased towards their closed position, and of displacing the chuck 7 and the jaws 8 towards and away from the interior of the casting head 1.

A suitable hydraulic system, which has not been illustrated for the sake of clarity, is provided for activating the primary piston 11 and the secondary piston 12 which reciprocate inside the cylinder 13. As is schematically illustrated, the cylinder 13 is provided witha pair of openings for hydraulic fluid to activate the piston 11. On the other hand, the portion of the piston 11 which projects through the end of the cylinder 13 remote from the casting head 1 is provided with a longitudinal passage for hydraulic fluid to activate the piston 12. A futher opening for hydraulic fluid to activate the piston 12 is provided near that end of the piston 11 which is connected with the inner sleeve 6. It will thus be seen that the piston 12 may be activated independently of the piston 11. However, the pistons 11 and 12 may also be moved in unison.

It will be noted that the inner sleeve 6 and the chuck 7 have confronting abutment surfaces. These abutment surfaces are so arranged that the inner sleeve 6 is able to urge the chuck 7 towards the mold sections 2 in response to movement of the piston 11 towards the mold sections 2.

In operation, the pistons 11 and 12 are displaced away from the casting head 1, that is, in the right-hand direction as seen in the drawing. This causes the mold sections 2 to come together to form a mold and also causes the chuck 7 and the jaws 8 mounted theron to move away from the mold. Molten material is admitted into the mold and the casting head 1 is set into rotation by the electric motor 14 via the transmission 15 and non-illustrated belts engaging a shaft of the transmission 15 and recesses 18 provided in the casting head 1.

When the casting operation has been completed and the molten material has solidified, the pistons 11 and 12 are displaced in the direction of the casting head 1, that is, in the left-hand direction as seen in the drawing. As a result of this movement, the mold sections 2 are drawn apart to expose the casting inside the mold and the chuck 7 and jaws 8 are moved towards the casting. At sometime before the jaws 8 reach the location of the casting, the piston 12 is displaced in the direction of the casting independently of the piston 11 in order to cause the rod 10 to be displaced relative to the chuck 7 in the direction of the casting. This movement of the rod 10, and the associated movement of the rod 9 mounted thereon, causes the spherical head of the rod 9 to force the jaws 8 apart to their open position. It will be noted that the extent to which the rod 10 can move relative to the chuck 7 is limited by the enlarged head provided on the rod 10 at the end thereof which is remote from the jaws 8.

Once the jaws 8 have been opened, the pistons 11 and 12 are displaced so that the jaws 8 embrace the casting. The piston 12 is then operated so as to cause the same to be displaced in a direction away from the casting, that is, in the right-hand direction as seen in the drawing. This motion of the piston 12 results in a closing of the jaws 8, which are biased towards their closed position, so that the jaws 8 grip the casting. The pistons 11 and 12 are now both displaced in a direction away from the casting head 1, that is, in the right-hand direction as seen in the drawing. This causes the casting to be withdraw from the casting head 1 and also causes the mold sections 2 to be brought back together for a further casting operation.

It will be appreciated that the invention has provided an apparatus which enables a centrifugal casting in split molds to be carried out in a simple and efficient manner and which thus makes it possible to centrifugally cast articles of complex configuration, e.g., cases of electric motors and other articles of somewhat complicated cylindrical shape, simply and efficiently.

It will be understood that various modifications may be made within the scope of the invention.

I claim:

1. Apparatus for centrifugal casting in split molds comprising:

a. a rotatable head having the configuration of a hollow frustum of a cone, said head being provided with a plurality of elongated slots extending along the generatrices thereof;

b. a plurality of mold sections which cooperate to define a mold for centrifugal casting, each of said sections being mounted in one of said slots for sliding movement therealong from a first position in which said sections cooperate to define said mold to a second position in which said sections are separated from one another so as to expose a casting formed in said mold;

c. gripping means for gripping the casting when said mold sections are in said second position and for withdrawing the casting from said head, said gripping means being mounted for axial movement interiorly of said head;

d. activating means for displacing said mold sections and said gripping means and for causing the latter to grip the casting; and e. drive means for rotating said head when said mold sections are in said first position to permit centrifugal casting with said head.

2. Apparatus as defined in claim 1, wherein said head is provided with a cylindrical extension at the smaller-diameter end thereof, said activating means comprising a cylinder-and-piston arrangement, and a sleeve connected with the piston of said arrangement and with said mold sections, said sleeve being slidably received in said extension, and said sleeve being fixed for reciprocating movement with said piston and being rotatable relative to the latter.

3. Apparatus as defined in claim 2, wherein said activating means comprises a sleeve member slidably interposed between said extension and said sleeve, and a plurality of bars pivotally connected with said sleeve member and with respective mold sections, said sleeve and sleeve and sleeve member having cooperating abutment surfaces so as to permit the reciprocating movement of said sleeve to be transmitted to said sleeve member and thereby to said mold sections.

4. Apparatus as defined in claim 2, wherein said piston is hollow and said activating means comprises a piston member received interiorly of said piston for reciprocating movement in the latter, said piston member being connected with said gripping means for displacing the latter and causing said gripping means to grip the casting formed in said mold.

5. Apparatus as defined in claim 4, wherein said gripping means comprises a chuck slidably received interiorly of said sleeve, and a pair of jaws pivotally mounted on said chuck, said activating means including a rod which is slidably received in said chuck, and said rod extending through said chuck from said jaws to said piston member so as to cause displacement of said chuck and opening and closing of said jaws in response to movement of said piston member, said rod being rotatable to said piston member.

6. Apparatus as defined in claim 1, wherein said gripping means comprises a pair of jaws having spaced, opposed arcuate surfaces and biased to closed position, and said activating means comprises a rod having a spherical end which is received in the space between said arcuate surfaces and engages the latter when jaws are closed, said activating means also including a drive for displacing said rod to thereby cause said spherical end to move from engagement with said arcuate surfaces and spread said jaws apart to open position.

* * * * *